United States Patent [19]

Harris

[11] 4,219,333

[45] Aug. 26, 1980

[54] CARBONATED CLEANING SOLUTION

[76] Inventor: Robert D. Harris, 8145-B Belvedere Ave., Sacramento, Calif. 95826

[21] Appl. No.: 922,441

[22] Filed: Jul. 3, 1978

[51] Int. Cl.[2] ..... B08B 3/00; C11D 3/00

[52] U.S. Cl. ..... 8/137; 8/149.1; 252/139; 252/157; 252/135; 8/661

[58] Field of Search ..... 8/137, 1 XB, 137, 149.1; 252/139, 157

[56] References Cited

U.S. PATENT DOCUMENTS

| | | | |
|---|---|---|---|
| 1,948,568 | 2/1934 | Faber et al. | 8/1 XB |
| 2,023,013 | 12/1935 | Faber et al. | 8/1 XB |
| 3,394,083 | 7/1968 | Shen | 252/157 |
| 3,769,224 | 10/1973 | Inamdrato | 252/157 |
| 3,915,902 | 10/1975 | Ancel et al. | 252/139 |

OTHER PUBLICATIONS

Hackh's Chemical Dictionary, Fourth Edition, (McGraw-Hill), p. 230.

*Primary Examiner*—A. Lionel Clingman
*Attorney, Agent, or Firm*—Criddle & Western

[57] ABSTRACT

An aqueous cleaning composition containing 0.1–5 percent of a detergent which may be nonionic or anionic, 0–1 percent of one or more alkaline builder salts and 0–5 percent of a volatile organic solvent wherein the cleaning solution is carbonated with carbon dioxide and maintained at a pressure of from about 1 to 10 atmospheres.

18 Claims, No Drawings

CARBONATED CLEANING SOLUTION

BACKGROUND OF THE INVENTION

This invention relates to carbonated cleaning solutions. More particularly, this invention relates to carbonated cleaning solutions having the ability to penetrate textile fibers and dissolve and/or lift both inorganic and organic materials from the fibers.

There are myriad types of cleaning solutions on the market for cleaning textile fibers such as carpets. Various processes such as dry cleaning, steam cleaning and shampooing take advantage of different types and kinds of cleaning solutions. Volatile petroleum based hydrocarbons are used in dry cleaning processes. Steam cleaning and shampooing may utilize one or more of the many soaps and synthetic detergents in an aqueous solution. Detergents may be classified as regular, industrial or high strength and are categorized as cationic, anionic or nonionic.

Each type of cleaning solution is formulated to loosen and disperse the soil from the textile fibers either physically or by chemical reaction. The soil can then be solubilized or suspended in such a manner that it can be removed from the fibers being cleaned.

Typically, soils refer to both organic and inorganic matter that comes in contact with the fibers and adheres thereto. Dirt particles, greases, oils, foods, cosmetics and paints are representative of the materials hereinafter referred to as "soils" that work their way onto and into various textile fibers.

Various types of fibers are used in making carpets. Wool is by far the most prevalent natural material used although a certain amount of cotton is also employed in washable carpet materials. Synthetic fibers may be made of a variety of different chemicals. Polyamide fibers such as the nylons are commonly used as are polyesters.

Some types of fibers are more absorbent to one particular type of soil than another. Soils in the form of particulate matter lodge at the base of the carpet, for example, and are very difficult to remove as by vacuuming or treatment with a cleaning solution. These particules are a cause of excessive carpet wear since they tend to damage fibers when pressure is placed between the particle and the fiber as by someone walking over a carpet or by a piece of furniture placed on the carpet. Other soils such as oils and fats adhere to the fibers and work their way between fiber strands. Other types of soils are absorbed by such fats and oils causing the carpets to stain or look dirty.

One of the basic drawbacks to many cleaning compositions is that, while apparently loosening and dispersing the soil, they fail to pick up and retain the soil and it is redeposited as the cleaning solution is removed from the surface being cleaned. It is also difficult to remove all of the detergent from the fiber surface such as in carpets, even when rinsing with large amounts of water or steam. As a result the carpet fibers become tacky from the film of detergent on them. This attracts and retains soil so the net effect is a cleaned carpet that will soil more easily after a cleaning than prior thereto.

Various methods have been proposed to prevent carpet from resoiling. Embrittling agents have been used in cleaning compositions to embrittle the surfactant and render the fiber surface non-tacky. Alumina, in various forms, has been proposed as an anti-soil reagent as have certain polymers such as carboxy methyl cellulose. While somewhat successful, there still remains a need for a cleaning composition and method which will efficiently clean and effectively remove soil from textile fibers without causing a resoiling problem.

Many cleaning solutions are quite alkaline and damage to fibers may occur when using too strong a detergent concentration. Also the large amounts of water required in most carpet cleaning operations cause the carpet and often the pad under the carpet to become saturated with water. Long periods of time are required for drying. Portions of the carpet which are inadequately dried may result in rotting or decomposition of the fibers.

OBJECTS AND SUMMARY OF THE INVENTION

It is an object of the present invention to provide a cleaning composition which effectively and efficiently removes soil from textile fibers which also acts as an anti-soil reagent.

It is a further object of this invention to provide a novel cleaning composition which rapidly penetrates textile fibers removing the soil therefrom with a lifting action.

Another object of the invention is to provide a cleaning composition which rapidly penetrates textile fibers removing the soil therefrom with a lifting action.

Another object of the invention is to provide a cleaning composition which causes no damage to textile fibers and which can be rapidly removed therefrom without leaving a residue thereon.

A still further object of this invention is to provide a method of cleaning textile fibers utilizing a minimal amount of an aqueous cleaning solution.

Yet another object of this invention is to provide a method of cleaning textile fibers which is fast drying and which does not leave a chemical residue upon the fibers when dried.

A different object of this invention is to provide a method of cleaning textile fibers with a non-toxic, non-imflammable cleaning solution which rapidly penetrates such fibers and which is easily removed from such fibers having a soil repellant effect thereon.

These and other objects are accomplished by means of an aqueous cleaning composition comprising 0.1–5 percent by weight of an anionic or nonionic detergent, 0–1 percent by weight of one or more alkaline builder salts and 0–5 percent by weight of a volatile organic solvent wherein the solution is carbonated with carbon dioxide and maintained at a pressure of from about 1 to 10 atmospheres. A method of utilizing the carbonated cleaning composition for cleaning carpets, upholstery and other textile fibers by applying the cleaning solution to the fibers is also part of this invention.

DETAILED DESCRIPTION OF THE INVENTION

Suitable detergents for use in the present invention comprise primarily any of the nonionic and anionic surfactants. The nonionic detergents seem to be preferable for purposes of carbonation. While typical nonionic and anionic detergents are enumerated herein it is to be emphasized that there are literally thousands of detergent mixtures or combinations and the recital of a representative number is not meant to be a limitation as to the scope of the invention. Moreover, two or more of the formulations listed could be used in combination as well as separately.

One suitable class of nonionic detergents is the alkyl phenol-ethylene oxide condensates having the formula:

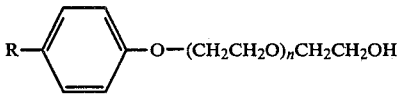

wherein R is an alkyl group having from nine to twelve carbon atoms and n is an integer of from eight to fourteen. Typical examples include dodecyl phenol condensed with an average of ten moles of ethylene oxide sold commercially as "Sterox DJ", nonyl phenol condensed with an average of nine or ten moles of ethylene oxide sold commercially as "Triton N101", "Igepal CO-630" and "Tergitol NPX" and dodecyl phenol condensed with an average of fifteen moles of ethylene oxide.

Another nonionic detergent class are the polyoxyalkylene alkanols having the empirical formula:

$$HO—(C_2H_4O)_a(C_3H_6O)_b(C_2H_4O)_cH$$

wherein b is an integer from 26 to 30 and a plus c is an integer such that the molecule contains from 0 percent to 20 percent of ethylene oxide. Typical examples thereof include "Pluronic L-61" where b is an integer from 26 to 30 and a plus c is an integer such that the molecule contains from 10 percent to 20 percent of ethylene oxide and "Pluronic L-60" where b is an integer from 26 to 30 and a plus c is zero so that the molecule is all polyoxypropylene. These detergents are low sudsing.

Another class of nonionic detergents include condensation products of a fatty alcohol with ethylene oxide to produce compounds having the formula:

$$R—O—(C_2H_4O)_nH$$

wherein R is an alkyl group containing from 10 to 20 carbon atoms and is preferably a straight chain alkyl group, and n is an integer of from 6 to 14. The alkyl content of these compositions can vary from 10 to 20 carbon atoms within the same mixture due to methods of manufacture. Therefore, the detergent will usually be one containing mixed alkyl groups. The same is true for the ethylene oxide groups and thus, ethylene oxide chains having different lengths will be produced within the same mixture. Typical products include Neodol 25-7 and Neodol 45-11 (Shell Chemical Company) wherein R is mixed alkyl from 12 to 15 and 14 and 15 carbon atoms respectively and n is an average of 11 and Plurofac B-26 (Wyandotte Chemical Co.) which is a linear alcohol reacted with a mixture of ethylene and propylene oxides.

Exemplary anionic materials are the water-soluble, straight and branched chain alkylarly sulfonates, particularly the alkyl benxene sulfonates, wherein the alkyl group contains from about 8 to 15 carbon atoms, the lower aryl or hydrotropic sulfonates such as sodium zylene sulfonate; the olefin sulfonates, such as those produced by sulfonating a $C_{10}$ to $C_{20}$ straight-chained-olefin; hydroxy $C_{10}$ to $C_{24}$ alkyl sulfonates; water-soluble alkyl disulfonates containing from about 10 to 24 carbon atoms; the normal and secondary higher alkyl detergents; particularly those having about 8 to 15 carbon atoms in the alkyl residue such as lauryl or coconut fatty alcohol sulfate; sulfuric acid esters of polyhydric alcohols partially esterified with higher fatty acids such as coconut oil, monoglyceride, monosulfate, coconut, ethanolamide sulfate, lauric acid amide or taurine and the like; the various soaps or salts of fatty acids containing from 8 to 22, particularly 10 to 18, carbon atoms, such as the sodium, potassium, ammonium and lower alkanol-amine, particularly mono-, di- and tri-ethanolamine salts of fatty acids such as stearic acid, oleic acid, coconut fatty acid, fatty acids derived from palm oil, soybean oil, tallow and the like. Particularly preferred anionic surfactants include the fatty alcohol and ether alcohol sulfates and the sodium salts of fatty acids containing from about 10 to 18 carbon atoms.

The composition of the present invention also includes an anionic detergent which is a sulfated ethoxylated higher fatty alcohol of the formula $RO(C_2H_4O)_n-SO_3M$ wherein R is a fatty alkyl of from 10 to 20 carbon atoms, n is from 2 to 6, and M is a solubilizing salt-forming cation such as an alkali metal, ammonium, lower alkylamino or lower alkanolamino. The fatty alkyl may be terminally joined to the polyxyethylene chain, which, of course, is terminally joined to the sulfur-forming sulfate group.

The ethylene oxide content of the anionic detergent is such that n is from 2 to 6 and is preferably from 2 to 4, generally averaging from 3, especially when R is a mixed 12 to 15 carbon atom alkyl. To maintain a desired hydrophilic-lipophilic balance, when the carbon content of the alkyl chain is in the lower portion of the 10 to 20 range, the ethylene oxide content might be reduced do that n is about 2, whereas when R is of 16 to 18 carbon atoms, n may be from 4 to 6. The salt forming cation may be any suitable solubilizing metal or radical but will most frequently be alkali metal or ammonium. If alkylamine or lower alkanolamine groups are present, alkyls and alkanols thereof will usually contain one to four carbon atoms and the amines and alkanolamines may be mono-, di or tri-substituted, e.g., monoethanolamine, diisopropanbolamine, tri-methylamine.

One suitable anionic composition is available from Shell Chemical Company and is identified by them as Neodol 25-3S, the sodium salt, normally sold as a 60 percent active material, including about 40 percent of aqueous solvent medium of which a minor proportion is ethanol. Although Neodol 25-3S is sodium salt, the potassium salt and other suitable soluble salts may also be used either in partial or complete substitution for that of sodium.

Examples of the higher alcohol polyethenoxy sulfates which may be used as the anionic constituent of the present composition include: mixed $C_{12-15}$ normal primary alkyl triethenoxy sulfate, sodium salt; myristyl triethenoxy sulfate, potassium salt; n-decyl diethenoxy sulfate, diethanolamine salt, lauryl diethenoxy sulfate, ammonium salt; palmityl tetraethenoxy sulfate, sodium salt; mixed $C_{14-15}$ normal primary alkyl mixed tri- and tetra-ethenoxy sulfate, sodium salt; stearyl pantaethenoxy sulfate, trimethylamine salt and mixed $C_{10-18}$ normal alkyl triethenoxy sulfate, potassium salt. Minor proportions of the corresponding branched chain and medially alkoxylated compound such as those described above but modified to have ethoxylation at a medial carbon atom, e.g., one located four carbons from the end of the chain, may be employed but the carbon atom content of the higher alkyl will be the same. Similarly, the joinder of a normal alkyl may be at a secondary carbon one or two carbon atoms removed from the end of the chain. Most commercially available laundry detergents are believed to be anionic alkyl aryl sulfonates.

The alkaline builder salts which can be employed in the cleaning compositions include alkali metal silicates, phosphates, carbonates and borates and, to a lesser extent, alkali metal hydroxides. Typical of the alkaline builder salts are sodium orthosilicate, sodium metasilicate, sodium carbonate, trisodium phosphate, sodium tripolyphosphate, tetrasodium pyrophosphate, sodium hexametaphosphate and sodium tetraborate. Mixtures of two or more of the alkaline builder salts are often used advantageously to impart desired properties to detergent formulation such as pH and corrosion control.

A volatile hydrocarbon solvent may be used to aid in dissolving organic soils and promote drying. Typical classes of solvents include halogenated hydrocarbons, lower alkyl ethers containing one or two ether linkages and unsubstituted hydrocarbons all of which have a boiling point below 100° C.

The halogenated hydrocarbon solvents having the requisite volatility and chemical stability are the polyhalogenated lower alkyl materials having from one to five carbon atoms and preferably from one to three carbon atoms. Typical of such materials are 1,1-dichloro ethane, 1,2-dichloro ethane, dichloro methane, dibromo methane, 1,1-dichloro ethylene, 1,2-dichloro ethylene, 1,1-dichloro propane, 1,2-dichloro propane, 2,2-dichloro propane, 1,1-dichloro propylene-1, 1,2-dichloro propylene-1, 1,2-dichloro propylene-2, chloroform, 1,1,1-trichloro ethane, trichloroethylene and carbon tetrachloride.

The lower alkyl ethers may have alkyl groups ranging from one to four carbon atoms and have a single ether linkage. Typical of such ethers are diethyl ether, dipropyl ether, diisopropyl ether, methylpropylether, ethylpropyl ether, methylbutyl ether, ethylbutyl ether, diallyl ether, allylethyl ether, allypropyl ether and allylisopropyl ether.

Alkyl ethers having multiple ether linkages or free hydroxyl groups which are water soluble are wetting agents and may be added to assist the detergent action, especially of the nonionic surfactants. Typical of such wetting agents are the dialkyl ethers of glycol such as the diethyl ether of ethylene glycol.

Unsubstituted hydrocarbon solvents such as benzene, heptane and hexane may be used but are highly flammable and are therefore less preferred.

Other additives commonly found in commercial detergent compositions may also be utilized without departing from the scope of this invention. These include foaming agents, bleaches, optical brighteners, fillers, plasticizers, dyes, fragrances, anti-soil reagents, antiseptics, germicides and the like.

Essential to the proper functioning of the aqueous cleaning compositions is the carbonation. It is believed that the carbonation of the aqueous cleaning solutions described herein is the key to rapid, thorough cleaning of carpets and the like without leaving a detergent residue on the textile fiber. Obviously, carbonation of aqueous solutions is minimal at atmospheric pressure as is exhibited by opening a container of a carbonated beverage and letting it stand. The carbonation soon leaves the beverage in the container. The same is true with cleaning compositions. Therefore it is preferred that carbonation be carried out under a gauge pressure of from 1 to 10 atmospheres or from about 14.7 to 147 psig. Higher pressures may be utilized but are not considered necessary.

While chemical carbonation is possible by mixing such reagents as sodium bicarbonate and an acid together in the cleaning solution it is preferred to inject carbon dioxide directly into the cleaning solution in a pressure container such as a sprayer. The cleaning solution is prepared and diluted to the proper concentration in a vessel or container capable of being maintained under pressure. The amount or degree of carbonation will be a function of the pressure in the container and the amount of carbon dioxide supplied to the container. Preferably the carbon dioxide is fed from a pressurized cylinder directly into a spray tank which is put under pressure. If desired solid carbon dioxide, i.e. dry ice, may be used as a source of carbonation. An advantage of using a pressurized cylinder is that the $CO_2$ feed can be controlled and monitored.

Carbonation of the cleaning solution and application of such solution to a carpet or other fiberous materials is carried out at ambient temperatures. It is evident that at higher pressures the degree of carbonation will be greater than at lower pressures.

Prior to carbonation the cleaning solution will have an alkaline pH and is preferably buffered at a pH of between about 9 and 12 by standard acid-base buffering agents. At an alkaline pH the cleaning solution may adversely affect certain textile fibers. However, upon carbonation, the pH of the cleaning solution is lowered by the formation of carbonic acid such that the pH, at the time the carbonated solution is applied to the textile fiber, is essentially neutral.

The carbonated cleaning solution breaks into myriad tiny effervescent white foam bubbles when applied to a carpet or similar material and rapidly penetrates the textile fibers. Comparable tests with both uncarbonated and carbonated cleaning solutions have demonstrated that the carbonated solutions penetrate and clean a tightly woven carpet approximately 50 percent faster and better than the uncarbonated cleaner. Moreover carpets, when cleaned with the carbonated solution do not resoil as rapidly as carpets cleaned with uncarbonated solutions.

While not fully understood and not wanting to be limited to any theory, it is believed that the carbonation of the aqueous solution results in a rapid lifting action due to the multitude of effervescent bubbles. The soil is stripped off the textile fibers by chemical or physical means and is lifted to the surface by the bubbles. Dirt particles can be easily removed from the top of the carpet or other textile surface in a conventional manner. The effervescent bubbles promote rapid drying of the fibers and evaporation of the cleaning solution along with dissolved soils into the atmosphere. Because the $CO_2$ bubbles promote rapid drying, little or no cleaning solution is left on the fibers thereby imparting a soil resistant quality to the cleaned fibers. It is also believed that the bubbling action of the cleaning solution enhances the cleaning ability of the surfactants.

The following examples are presented to illustrate the invention and are not to be considered as self limiting as to the scope of the invention.

EXAMPLE I

An aqueous detergent concentrate was prepared by mixing the following ingredients:

| Component | % Weight |
|---|---|
| Surfactant A[1] (nonionic) | 2.0 |
| Surfactant B[2] (nonionic) | 1.0 |
| Fragrance | 0.1 |
| Optical Brightener | 0.05 |
| Bleach | 0.05 |
| Sodium Carbonate | 0.75 |
| Sodium Tripolyphosphate | 0.1 |
| Sodium Metasilicate | 0.1 |
| Dye | trace |
| Acid-Base Buffer (pH 11–12) | 0.05 |
| Water | 95.8 |

[1]Triton N-101 (nonyl Phenoxy polyethoxy ethanol containing 9–10 moles of ethylene oxide)
[2]Triton CF-10 (benzyl ether of Phenol condensed with ethylene oxide)

The above concentrate was diluted with four parts of water to one part of concentrate and transferred to a spray can. The can was pressurized to a pressure of about 62 psig and carbon dioxide was injected through a quick-coupler located at the base of the sprayer. The $CO_2$ was passed through multiple air jets below the solution surface and fanned out for absorption into the cleaning solution. The sprayer was shaken to provide a uniform degree of carbonation and the $CO_2$ source was disconnected.

The carbonated aqueous solution was sprayed directly onto a carpet made from a blend of wool and nylon which had been soiled with mud, used motor oil, cocoa and lipstick. The solution emerged from the sprayer as a very active effervescent, white, frothy, foam which rapidly penetrated into the carpet. The carpet was brushed with fabric discs and the foam and the remaining solution was removed by a wet-dry vacuum. The carpet dried rapidly and no traces of the soil could be seen. After several months of heavy foot traffic no respotting or resoiling could be seen where the original soil had been placed.

EXAMPLE 2

The following concentrate, while very effective, was rather difficult to prepare and had to be formulated using the steps as outlined.

Into a one gallon container was placed 2,000 mls of water to which was added 100 mls of a nonionic condensation product of a mixed fatty alcohol having 14–15 carbons with ethylene oxide to produce a polyethoxylated alkanol having an average of 11 ethylene oxide units. (Neodol 45-11). The mixture was thoroughly agitated. There was then added 40 mls of a nonionic surfactant consisting of a polyoxyalkylene alkanol having 26 to 30 units of propylene oxide condensed with ethylene oxide such that the molecule contained 10–20 percent ethylene oxide. (Pluronic L-61). The mixture was again agitated whereupon 60 mls of ethylene glycol diethyl ether was added as a wetting agent. After a thorough mixing, 150 mls of methylene chloride was added and the solution was agitated until milky in color. Water was then added to make one gallon of concentrate. One part of concentrate was diluted with three parts water and was transferred to a pressure sprayer and carbonated with carbon dioxide under a pressure of about 88 psig. Application of this formulation to a soiled carpet in the manner described in Example 1 produced the same excellent results. The carpet dried very rapidly due to the presence of methylene chloride in addition to the carbonation and left no noticeable residue as evidenced by the lack of resoiling over a period of time.

EXAMPLE 3

A concentrate was prepared containing 2.5 percent of dodecyl phenol condensed with ten moles of ethylene oxide (Sterox DJ) and 2.5 percent of an ethoxylated vegetable oil (Emulphor EL-620) which was diluted with water at a ratio of one part concentrate to five parts water. Carbonation under a pressure of about 75 psig resulted in a solution that was very effervescent when applied via a spray nozzle to a carpet surface. The carbon dioxide helped remove the aqueous solution from the fibers resulting in rapid drying of the clean carpet.

Other formulations were prepared using commercial anionic detergents (Tide, Bold, Cheer etc.) in concentrations of about 1 to 5 percent by weight. Each solution was carbonated as in the above examples. The results obtained in each case were superior to comparable results obtained with the same formulation in an uncarbonated state.

The above examples are illustrative of the claimed invention. However, the scope of the invention is to be limited only by the appended claims.

I claim:

1. An aqueous cleaning composition containing from about 0.1 to 5.0 percent by weight of one or more nonionic or anionic surfactants wherein the composition is carbonated and maintained at a pressure of from about 1 to 10 atmospheres.

2. An aqueous cleaning composition according to claim 1 wherein the composition is carbonated by subjecting the composition to gaseous carbon dioxide under pressure.

3. An aqueous cleaning composition according to claim 1 wherein the composition is carbonated by subjecting the composition to solid carbon dioxide under pressure.

4. An aqueous cleaning composition according to claim 1 which additionally contains from about 0.01 to 1.0 percent of an alkaline builder salt.

5. An aqueous cleaning composition according to claim 4 wherein the alkaline builder salt is selected from the group consisting of alkali metal silicates, phosphates, carbonates and borates.

6. An aqueous cleaning composition according to claim 1 which additionally contains from about 0.1 to 5.0 percent by weight of a volatile organic solvent having a boiling point below about 100° C.

7. An aqueous cleaning composition according to claim 6 wherein the volatile organic solvent is a member selected from the group consisting of halogenated hydrocarbons having from one to three carbon atoms, lower alkyl ethers having one ether linkage and unsubstituted hydrocarbons.

8. An aqueous cleaning composition according to claim 7 wherein the volatile organic solvent is methylene chloride.

9. An aqueous cleaning composition according to claim 1 wherein the surfactant is nonionic.

10. A method of cleaning textile fibers which comprises contacting the fibers with a carbonated aqueous cleaning solution having a nonionic or anionic surfactant concentration of between about 0.1 and 5.0 percent by weight.

11. A method of cleaning textile fibers according to claim 10 which comprises applying the carbonated aqueous cleaning solution to the textile fibers as a pressurized spray.

12. A method of cleaning textile fibers according to claim 11 which comprises the steps of placing an uncarbonated aqueous cleaning solution into a container capable of being pressurized, introducing carbon dioxide into the container which is maintained at a pressure of between about 1 and 10 atmospheres and applying the pressurized carbonated cleaning solution to the textile fibers.

13. A method of cleaning textile fibers according to claim 12 wherein the textile fibers are in the form of a carpet.

14. A method of cleaning textile fibers according to claim 13 wherein the aqueous cleaning solution is carbonated by means of pressurized gaseous carbon dioxide.

15. A method of cleaning textile fibers according to claim 13 wherein the aqueous cleaning solution is carbonated by means of solid carbon dioxide.

16. A method of cleaning textile fibers according to claim 14 which comprises mechanically working the carbonated cleaning solution into the fibers and subsequently removing the cleaning solution which is not evaporated from the fibers.

17. A method of cleaning textile fibers according to claim 15 wherein the carbonated aqueous cleaning solution also contains about 0.01 to 1.0 percent by weight of an alkaline builder salt.

18. A method of cleaning textile fibers according to claim 15 wherein the carbonated aqueous cleaning solution also contains about 0.1 to 5.0 percent by weight of a volatile organic solvent having a boiling point below about 100° C.

* * * * *

REEXAMINATION CERTIFICATE (170th)

United States Patent [19]

Harris

[11] B1 4,219,333

[45] Certificate Issued Feb. 28, 1984

[54] CARBONATED CLEANING SOLUTION

[75] Inventor: Robert D. Harris, Sacramento, Calif.

[73] Assignee: Harris Research Inc., Sacramento, Calif.

Reexamination Request:
No. 90/000,272, Oct. 19, 1982

Reexamination Certificate for:

| | |
|---|---|
| Patent No.: | **4,219,333** |
| Issued: | **Aug. 26, 1980** |
| Appl. No.: | **922,441** |
| Filed: | **Jul. 3, 1978** |

[51] Int. Cl.[3] ..... B08B 3/00; C11D 3/00

[52] U.S. Cl. ..... 8/137; 8/149.1; 8/661; 252/139; 252/157; 252/135

[56] References Cited

U.S. PATENT DOCUMENTS

| | | |
|---|---|---|
| 1,723,070 | 8/1929 | Payson et al. . |
| 1,901,960 | 3/1933 | Goss . |
| 2,181,691 | 8/1936 | Bucy . |
| 2,220,146 | 11/1940 | Curry . |
| 3,882,038 | 5/1975 | Clayton et al. . |

FOREIGN PATENT DOCUMENTS

| | | |
|---|---|---|
| 985113 | 3/1976 | Canada . |

OTHER PUBLICATIONS

The Condensed Chemical Dictionary, 8th edition, 1971, p. 111.

*Primary Examiner*—Paul R. Michl

[57] ABSTRACT

An aqueous cleaning composition containing 0.1–5 percent of a detergent which may be nonionic or anionic, 0–1 percent of one or more alkaline builder salts and 0–5 percent of a volatile organic solvent wherein the cleaning solution is carbonated with carbon dioxide and maintained at a pressure of from about 1 to 10 atmospheres.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 10, 12, 14, and 15, having been finally determined to be unpatentable, are cancelled.

Claims 4–9, 11, 13, and 16–18 are patentable as amended:

New claims 19 and 20 are added and determined to be patentable.

4. An *effervescent carbonated* aqueous cleaning composition according to claim [1] *19* which [additionally] contains from about 0.01 to 1.0 percent of [an] *one or more* alkaline builder salts.

5. An *effervescent carbonated* aqueous cleaning composition according to claim 4 wherein the alkaline builder [salt] *salts* [is] *are* selected from the group consisting of alkali metal silicates, phosphates, carbonates and borates.

6. An *effervescent carbonated* aqueous cleaning composition according to claim [1] *19* which [additionally] contains from about 0.1 to 5.0 percent by weight of a volatile organic solvent having a boiling point below about 100° C.

7. An *effervescent carbonated* aqueous cleaning composition according to claim 6 wherein the volatile organic solvent is a member selected from the group consisting of halogenated hydrocarbons having from one to three carbon atoms, lower alkyl ethers having one ether linkage and unsubstituted hydrocarbons.

8. An *effervescent carbonated* aqueous cleaning composition according to claim 7 wherein the volatile organic solvent is methylene chloride.

9. An *effervescent carbonated* aqueous cleaning composition according to claim [1] *19* wherein the surfactant is nonionic.

11. A method of cleaning textile fibers according to claim [10] *20* which comprises applying the *effervescent* carbonated cleaning [solution] *composition* to the textile fibers as [a] *an effervescing* pressurized spray.

13. A method of cleaning textile fibers according to claim [12] *11* wherein the textile fibers are in the form of a carpet.

16. A method of cleaning textile fibers according to claim [14] *11* which comprises mechanically working the *effervescent* carbonated cleaning [solution] *composition* into the fibers and subsequently removing the cleaning [solution] *composition* which is not evaporated from the fibers.

17. A method of cleaning textile fibers according to claim [15] *11* wherein the *effervescent* carbonated aqueous cleaning [solution] *composition* [also] contains about 0.01 to 1.0 percent by weight of [an] *one or more* alkaline builder [salt] *salts*.

18. A method of cleaning textile fibers according to claim [15] *11* wherein the *effervescent* carbonated aqueous cleaning [solution] *composition* also contains about 0.1 to 5.0 percent by weight of a volatile organic solvent having a boiling point below 100° C.

*19. An effervescent, carbonated aqueous cleaning composition consisting essentially of 0.1 to 5.0 percent by weight of one or more nonionic and anionic surfactants, 0 to 1.0 percent by weight of one or more alkaline builder salts, 0 to 5.0 percent by weight of a volatile organic solvent wherein said aqueous cleaning composition is contained in a pressure vessel maintained at a gauge pressure of 1 to 10 atmospheres and wherein said aqueous cleaning composition has been uniformly carbonated by introducing gaseous carbon dioxide into said composition by means of agitation in said pressure vessel under said gauge pressure and thereafter maintaining said gauge pressure to retain said uniform carbonation.*

*20. A method of cleaning textile fibers which comprises applying to said fibers, from a pressurized container maintained at a gauge pressure of from about 1 to 10 atmospheres, an effervescing carbonated aqueous cleaning compostion consisting essentially of 0.1 to 5.0 percent by weight of one or more nonionic and anionic surfactants, 0 to 1.0 percent by weight of one or more alkaline builder salts, 0 to 5.0 percent by weight of a volatile organic solvent, and water, said aqueous cleaning composition having been uniformly carbonated by introducing gaseous carbon dioxide into said composition by means of agitation in said pressure vessel under said gauge pressure and thereafter maintaining said gauge pressure to retain said uniform carbonation until said cleaning composition is applied to said fibers.*

* * * * *